US009901137B2

(12) United States Patent
Iuchi et al.

(10) Patent No.: US 9,901,137 B2
(45) Date of Patent: Feb. 27, 2018

(54) SOLE STRUCTURE FOR A SPORT SHOE

(71) Applicant: Mizuno Corporation, Osaka-shi (JP)

(72) Inventors: Kazunori Iuchi, Suita (JP); Keiji Kurayama, Sakai (JP); Kiyotaka Kuroda, Fuzhou (CN)

(73) Assignee: Mizuno Corporation, Osaka-shi (JP)

( * ) Notice: Subject to any disclaimer, the term of this patent is extended or adjusted under 35 U.S.C. 154(b) by 0 days.

(21) Appl. No.: 15/108,618

(22) PCT Filed: Apr. 21, 2015

(86) PCT No.: PCT/JP2015/062631
§ 371 (c)(1),
(2) Date: Jun. 28, 2016

(87) PCT Pub. No.: WO2015/163482
PCT Pub. Date: Oct. 29, 2015

(65) Prior Publication Data

US 2016/0316853 A1 Nov. 3, 2016

(30) Foreign Application Priority Data

Apr. 26, 2014 (JP) ..... 2014-092161

(51) Int. Cl.
*A43B 7/14* (2006.01)
*A43B 13/18* (2006.01)
(Continued)

(52) U.S. Cl.
CPC ..... *A43B 13/186* (2013.01); *A43B 5/00* (2013.01); *A43B 7/087* (2013.01); *A43B 7/145* (2013.01);
(Continued)

(58) Field of Classification Search
CPC ..... A43B 7/1425; A43B 7/145; A43B 13/12; A43B 13/141; A43B 17/16
(Continued)

(56) References Cited

U.S. PATENT DOCUMENTS 3,034,235 A * 5/1962 Hunting ..... A43B 23/082 36/72 R
4,870,762 A * 10/1989 Lee ..... A43C 13/14 36/77 R
(Continued)

FOREIGN PATENT DOCUMENTS

JP 2-114904 A 4/1990
JP 3215664 B2 10/2001
(Continued)

OTHER PUBLICATIONS

International Search Report of the International Searching Authority for International Application PCT/JP2015/062631, dated Sep. 1, 2015, 1 page, Japanese Patent Office, Tokyo, Japan.
(Continued)

*Primary Examiner* — Marie Bays
(74) *Attorney, Agent, or Firm* — W. F. Fasse

(57) ABSTRACT

A sole structure for a sport shoe can increase accelerating force during activities and achieve quick movements. A sole assembly 1 for an indoor shoe includes a sole body 2 formed of a soft elastic member and a plate-like member or planar sheet member 3 that is disposed at a position under the first to fourth distal phalanx $DP_1$-$DP_4$ of the wearer's foot on a foot sole contact surface 2A of the sole body 2, and that has a higher hardness than that of the sole body 2. The plate-like member 3 extends arcuately substantially in the foot width direction along the toes of the wearer's foot and has a narrow
(Continued)

part 3C of a short length in the foot length direction, or a spacing gap, at a region between the first toe and the second toe.

15 Claims, 11 Drawing Sheets

(51) Int. Cl.
*A43B 5/00* (2006.01)
*A43B 7/08* (2006.01)
*A43B 13/04* (2006.01)
*A43B 13/12* (2006.01)
*A43B 23/08* (2006.01)

(52) U.S. Cl.
CPC ..... *A43B 13/04* (2013.01); *A43B 13/12* (2013.01); *A43B 13/188* (2013.01); *A43B 23/087* (2013.01)

(58) Field of Classification Search
USPC ..... 36/25 R, 30 R, 31, 77 R, 88, 43, 44
See application file for complete search history.

(56) References Cited

U.S. PATENT DOCUMENTS 4,924,606 A * 5/1990 Montgomery ..... A43B 3/30 36/102
5,007,184 A * 4/1991 Lee ..... A43B 23/082 36/72 R
5,638,613 A * 6/1997 Williams ..... A43B 5/00 36/132
5,647,145 A * 7/1997 Russell ..... A43B 3/0052 36/25 R
5,786,057 A * 7/1998 Lyden ..... A43B 5/00 139/422
6,219,940 B1 4/2001 Kita
6,389,715 B1 * 5/2002 Krajcir ..... A43B 7/32 36/72 R
7,017,286 B2 * 3/2006 Covatch ..... A43B 23/082 12/146 D
7,210,250 B2 * 5/2007 Gallegos ..... A43B 1/0054 36/140
7,421,805 B2 * 9/2008 Geer ..... A43B 3/0036 36/102
7,487,604 B2 * 2/2009 Perron, Jr. ..... A43B 5/02 36/102
8,117,769 B2 * 2/2012 Steele ..... A43B 3/30 36/102
8,146,269 B2 * 4/2012 Mueller ..... A43B 3/0036 36/144
8,186,081 B2 * 5/2012 Wilson ..... A43B 3/0052 36/107
8,479,416 B2 * 7/2013 Auger ..... A43B 7/1445 36/102
8,621,765 B2 * 1/2014 Geer ..... A43B 9/06 36/12
8,732,981 B2 * 5/2014 Cobb ..... A43B 13/145 36/25 R
2002/0112373 A1 * 8/2002 Talbott ..... A43B 5/06 36/25 R
2004/0221489 A1 * 11/2004 Hung ..... A43B 7/32 36/136
2005/0034328 A1 * 2/2005 Geer ..... A43B 3/0036 36/30 R
2009/0188131 A1 * 7/2009 Doerer ..... A43B 7/1425 36/88
2010/0139121 A1 * 6/2010 Geer ..... A43B 9/06 36/88
2011/0192049 A1 * 8/2011 Auger ..... A43B 7/1445 36/44
2011/0302806 A1 * 12/2011 Auger ..... A43B 7/1445 36/44
2013/0333241 A1 * 12/2013 Auger ..... A43B 7/1445 36/44
2015/0143715 A1 * 5/2015 Auger ..... A43B 7/1445 36/44

FOREIGN PATENT DOCUMENTS

JP 2005-095388 A 4/2005
JP 4709085 B2 6/2011

OTHER PUBLICATIONS

PCT International Preliminary Report on Patentability including English Translation of PCT Written Opinion of the International Searching Authority for International Application PCT/JP2015/062631, dated Nov. 1, 2016, 5 pages, International Bureau of WIPO, Geneva, Switzerland.
English translation of Japanese Office Action in Japanese Patent Application No. 2014-092161, 2 pages.

* cited by examiner

SOLE STRUCTURE FOR A SPORT SHOE

TECHNICAL FIELD

The present invention relates generally to a sole structure for a sport shoe, and more particularly, to an improved sole structure that can increase accelerating force during activities and enables quick movements.

BACKGROUND ART

The applicant of the present invention proposed a sole structure for a sport shoe such as shown in Japanese Patent No. 3215664. In the sole structure shown in the patent publication, the wavy corrugated sheet is interposed inside the midsole of a soft elastic member and it extends from the heel part of the midsole through the midfoot part to the position near the thenar eminence of the forefoot part. Thereby, a lateral swing can be prevented at the region from the heel part to the midfoot part of the midsole after impacting the ground, thus securing stability during running (see para. [0091] and FIGS. 5-7).

In the structure described in the above publication, the wavy corrugated sheet, which is disposed at the region extending from the midfoot part of the midsole to the position near the thenar eminence of the forefoot part, enabled an increase of resiliency to some degree when impacting the ground on the forefoot part during activities, but it was not sufficient. For example, in indoor sports such as volleyball, handball or the like, the prior-art structure did not adequately correspond to demand that accelerating force is further increased during activities and quicker movements are achieved.

The present invention has been made in view of these circumstances and its object is to provide a sole structure for a sport shoe that can increase accelerating force during activities and achieve quick movements.

DISCLOSURE OF INVENTION

A sole structure for a sport shoe according to the present invention includes a sole body formed of a soft elastic member and a plate-like member that is disposed at a position corresponding to toes of a foot on a foot sole contact surface side of the sole body and that has a higher hardness than that of the sole body.

According to the present invention, since the plate-like member of a higher hardness than that of the sole body is provided at the position corresponding to the toes of the foot on the foot sole contact surface side of the sole body, when a load is applied to the sole body from the toes during activities, the load acts on the soft sole body through the hard plate-like member. At this moment, compared to the case in which the load from the toes is imparted directly to the sole body and the soft sole body is thus locally deformed such that the load is absorbed by the sole body, the load from the toes is imparted to the sole body through the hard plate-like member thus restraining a local deformation of the sole body to prevent the load from the toes from being absorbed by the sole body. Since a greater resiliency can thus be achieved accelerating force can be increased during activities. As a result, quick movements can be achieved. For example, one can quickly move onto a dash, sidestep and jumping that require a push-off motion of the toes.

The plate-like member may be located at a position directly under a first distal phalanx to a fourth distal phalanx of the foot. In this case, the load at the time of the push-off motion can be effectively transmitted to the plate-like member.

The plate-like member may extend substantially in a foot width direction along the toes and have a short length in a foot length direction at a region between a first toe and a second toe. In this case, on opposite sides of a region between the first toe and the second toe, a region on the first toe side and a region on the second toe side are easy to bend respectively in the foot width direction, thereby smoothly transferring the load (strictly speaking, the center of foot pressure) in either case in which the foot pushes off on the first toe or on the fourth toe. As a result, quick movements due to an increase of accelerating force during activities can be achieved and at the same time transfer of the center of foot pressure can be smoothly conducted in either case in which the foot pushes off on the first toe or on the fourth toe.

The plate-like member may be composed of a first plate-like member disposed at a position corresponding to the first toe and a second plate-like member that is spaced away from the first plate-like member and that is disposed at a position corresponding to the second toe to the fourth toe. In this case, on opposite sides of a space of gap between the first and second plate-like members, the region on the first toe side and a region on the second to fourth toe sides are much easier to bend respectively in the foot width direction, thereby smoothly transferring the load (strictly speaking, the center of foot pressure) in either case in which the foot pushes off on the first toe or on the fourth toe. As a result, quick movements due to an increase of accelerating force during activities can be achieved and at the same time transfer of the center of foot pressure can be smoothly conducted in either case in which the foot pushes off on the first toe or on the fourth toe.

With regard to a rigidity of a midfoot region of the sole body, the rigidity of the midfoot region between a forefoot medial side and a heel lateral side may be made lower than that of the midfoot region between a forefoot lateral side and a heel medial side. In this case, since the midfoot region of the sole body has a structure that allows for ease of pronation, pronation is promoted at the time of activities and thus during activities the load easily concentrates on the thenar eminence side of the forefoot region of the sole body. Thereby, transfer of the load (strictly speaking, the center of foot pressure) to the thenar eminence side can be smoothly conducted. As a result of this, the center of foot pressure can be smoothly transferred to the plate-like member on the toe side. In such a way, accelerating force during activities can be further enhanced and much quicker movements can be achieved.

The plate-like member may extend to an outer circumferential edge portion of the sole body and have an upraised portion extending upwardly at the outer circumferential edge portion. In this case, a lateral swing of the foot at the time of push-off motion can be prevented by the upraised portion.

The upraised portion may act as a toe guard. The sport shoe may be an indoor shoe.

BEST MODE FOR CARRYING OUT THE INVENTION

Embodiments of the present invention will be hereinafter described in accordance with the appended drawings.

First Embodiment

FIGS. 1 to 6 show a sole structure for a sport shoe according to a first embodiment of the present invention. Here, an indoor shoe used in indoor sports such as volleyball, handball or the like is taken as an example of the sport shoe.

Figure 1:
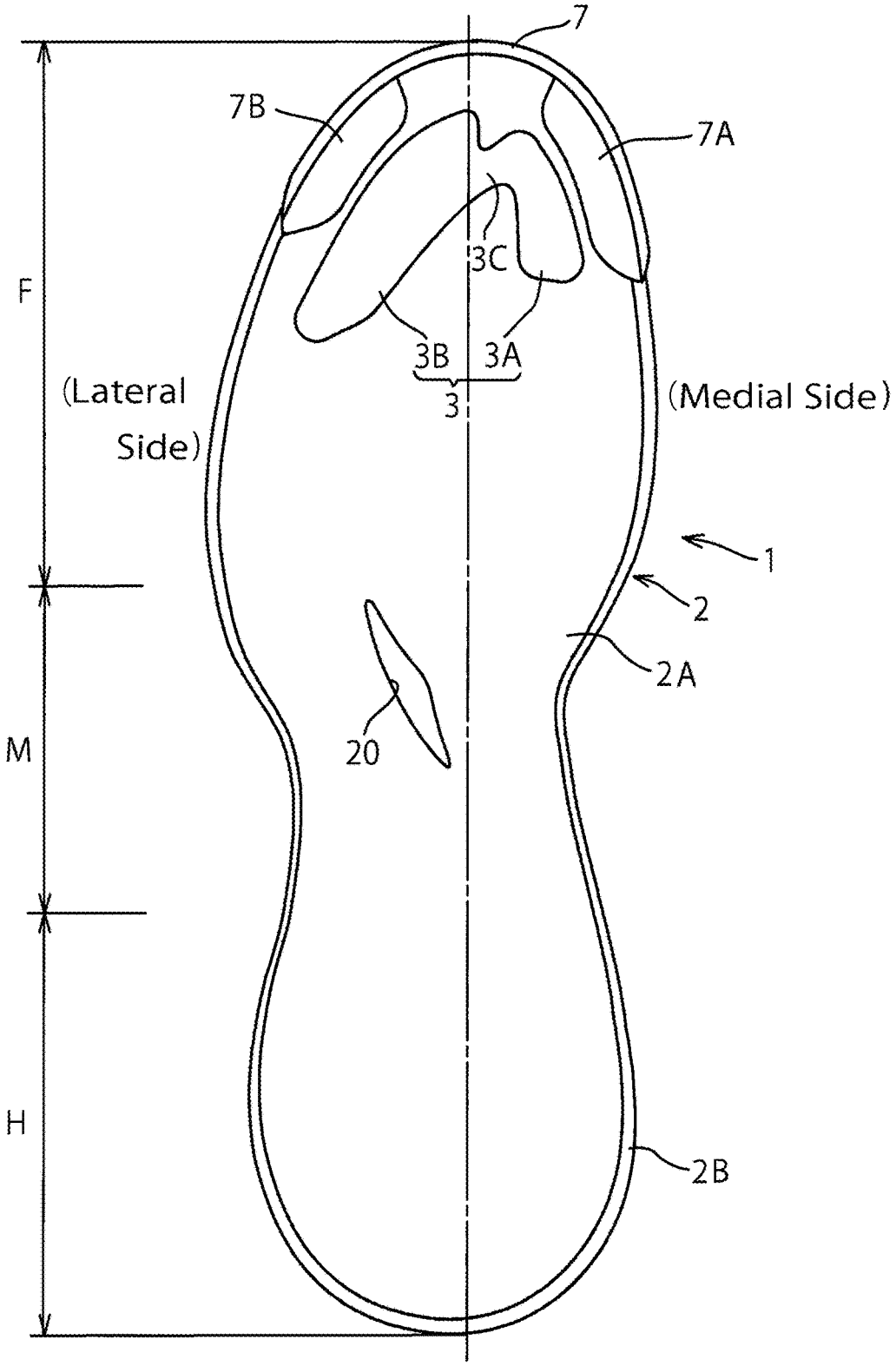
FIG. 1 is a top plan schematic view of a sole structure for a sport shoe according to a first embodiment of the present invention.
Figure 2:
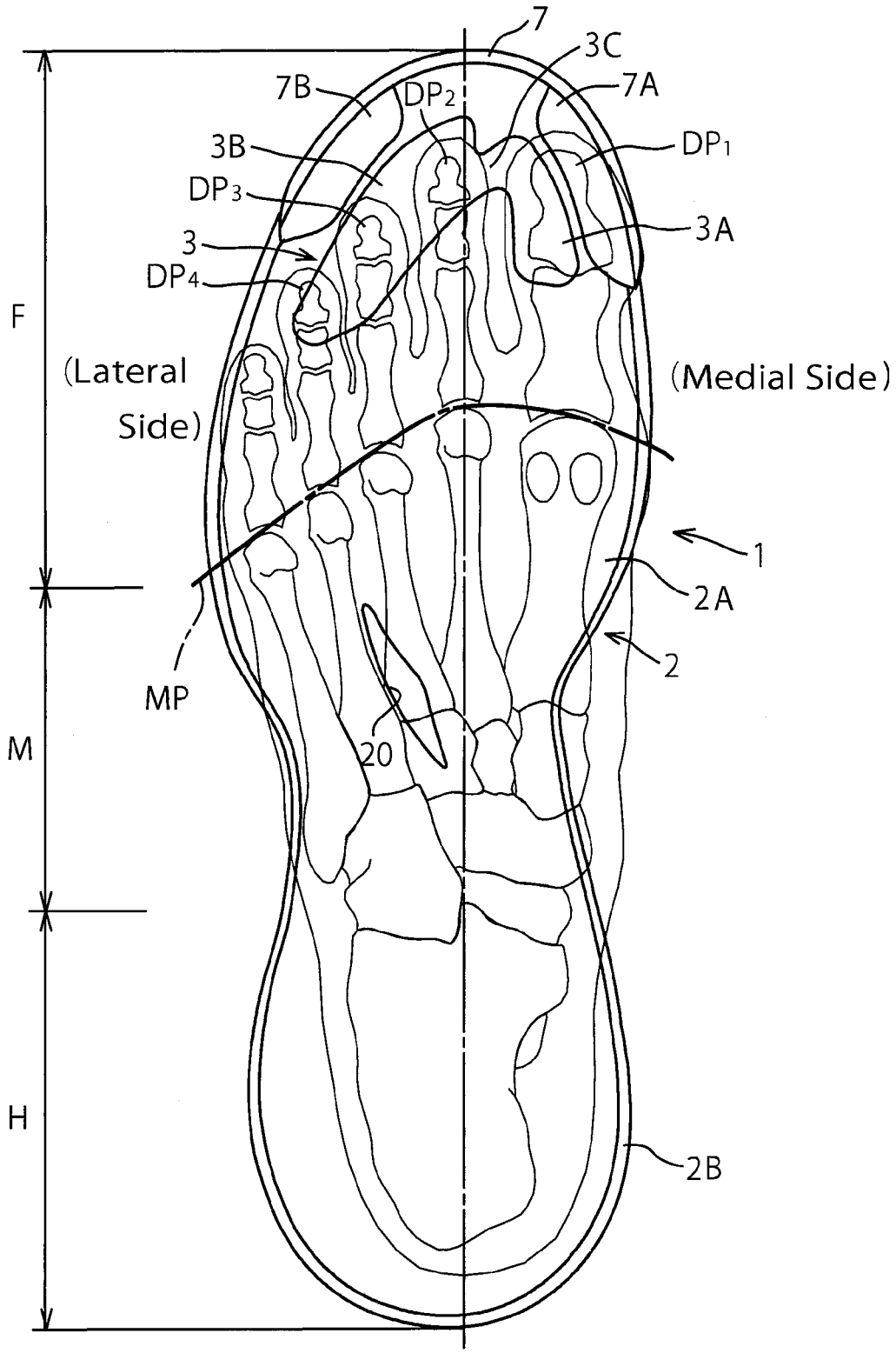
FIG. 2 is a top plan schematic view illustrating a positional relation between the sole structure of FIG. 1 and the bone structure of a foot.
Figure 3:
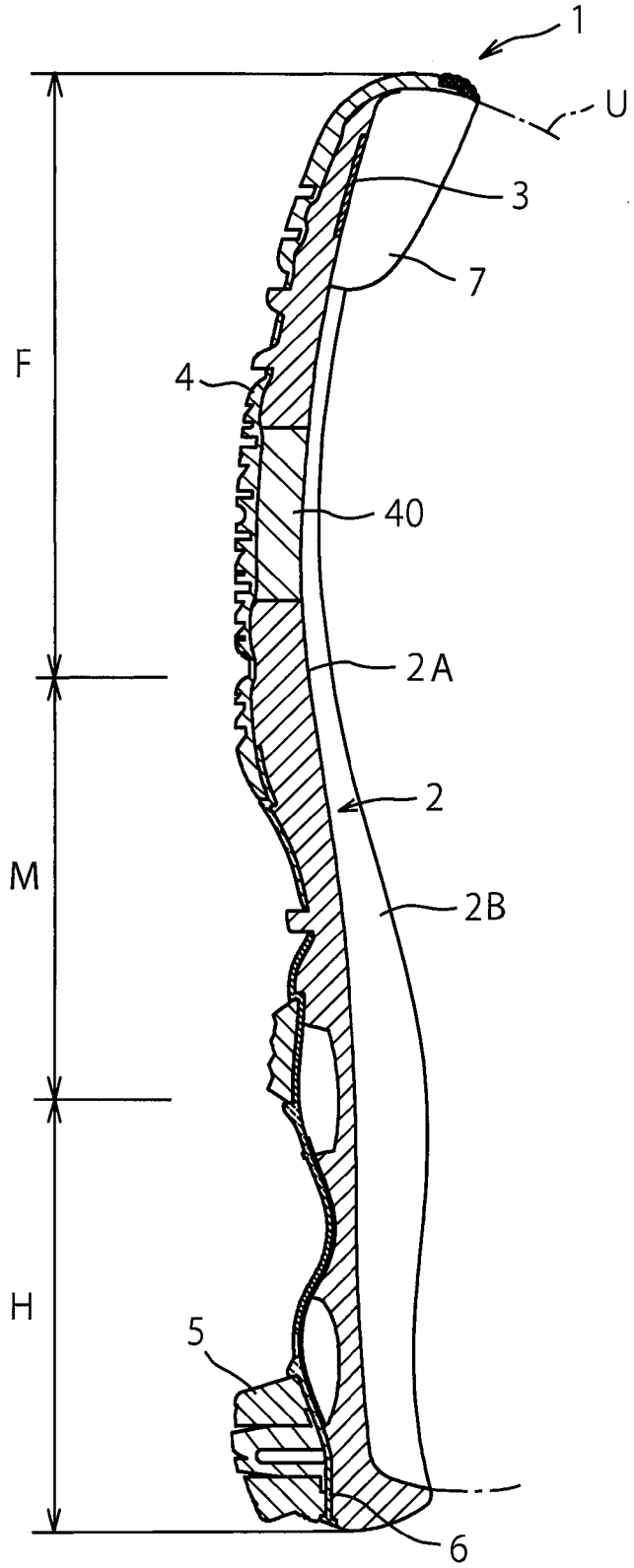
FIG. 3 is a longitudinal sectional view of the sole structure of FIG. 1.

As shown in FIGS. 1 to 3, sole structure 1 according to the present embodiment includes a sole body 2. The sole body 2 has a heel region H, a midfoot region M, and a forefoot region F that respectively correspond to a heel part, a midfoot part, and a forefoot part of a foot of a person who wears the shoe. The sole body 2 extends longitudinally from the heel region H through the midfoot region M to the forefoot region F. The sole body 2 has a foot sole contact surface or top surface 2A that is disposed on a foot sole contact side of the wearer.

On the foot sole contact surface or top surface 2A of the sole body 2, there is formed an upraised portion 2B that rises upwardly (i.e. out of the pages of FIGS. 1 and 2, to the right side of FIG. 3) along an approximately entire outer circumferential edge portion of the foot sole contact surface 2A. In FIG. 3, the upraised portion on the medial side only is shown. A bottom outer surface of an upper U for the sport shoe will be fixedly attached to an inner surface of the upraised portion 2B and to the top surface or foot sole contact surface 2A of the sole body 2 (see FIGS. 3 and 5).

The sole body 2 is formed of a soft elastic material, more specifically, thermoplastic resin such as ethylene-vinyl acetate copolymer (EVA) and the like, foamed thermoplastic resin, thermosetting resin such as polyurethane (PU) and the like, foamed thermosetting resin, rubber materials such as butadiene rubber, chloroprene rubber and the like, or foamed rubber materials. A hardness of the sole body 2 is set at, for example 45-75 C (in the Asker C scale). In this embodiment, formed EVA is used for the sole body 2 and its hardness is set at 55 C (±4 C for a tolerance).

Additionally, a planar sheet member or plate-like member 3 is provided at a position corresponding to toes of the foot on the foot sole contact surface or top surface 2A of the sole body 2. The planar sheet member or plate-like member 3 is preferably embedded into the foot sole contact surface 2A and a top surface of the plate-like member 3 is preferably flush with the foot sole contact surface 2A. As shown in FIGS. 1 and 2, the plate-like member 3 is a thin component that extends arcuately along the toes substantially in a foot width direction (i.e. the left to right direction in FIG. 2). The plate-like member 3 is formed of a first plate-like portion 3A located at a position corresponding to a first toe, a second plate-like portion 3B located at a position corresponding to a second toe to a fourth toe, and a narrow part 3C that has a smaller length in a foot length direction (i.e. upwardly and downwardly in FIGS. 1 and 2) between the first plate-like portion 3A and the second plate-like portion 3B (i.e. between the first toe and the second to fourth toes).

More specifically, as shown in FIG. 2, the first plate-like portion 3A is located at a position right under a first distal phalanx $DP_1$ and the second plate-like portion 3B is located at a position right under the second to fourth distal phalanges $DP_2$-$DP_4$. In FIG. 2, a reference number MP designates metatarsophalangeal joints. The plate-like member 3 does not overlap with the MP joints.

The plate-like member 3 is formed of a hard elastic material which has a higher hardness than that of the sole body 2, more specifically, thermoplastic resin such as ethylene-vinyl acetate copolymer (EVA) and the like, thermosetting resin such as polyurethane (PU) and the like, rubber materials such as butadiene rubber, chloroprene rubber and the like. A hardness of the plate-like member 3 is set at 45-75 D (in the Asker D scale) in the case of the resin material for the plate-like member 3, or 60-80 A (in the Asker A scale) in the case of the rubber material for the plate-like member 3. In this embodiment, a hard EVA sheet is used for the plate-like member 3 and its hardness is set at 80 A (±3 A for a tolerance), which is higher than the hardness 55 C of the sole body 2.

Figure 4:
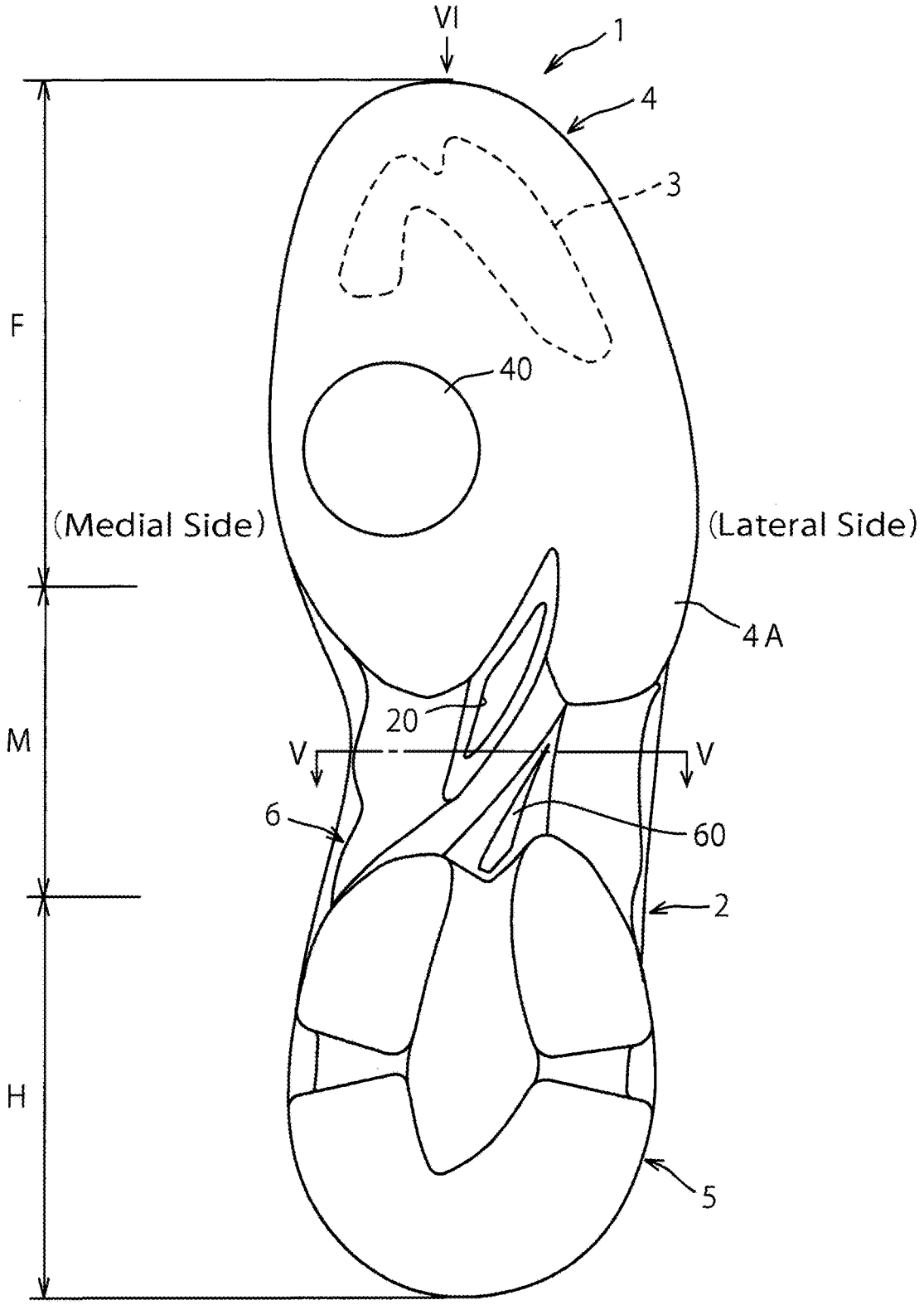
FIG. 4 is a bottom schematic view of the sole structure of FIG. 1.

As shown in FIGS. 3 and 4, outsoles 4 and 5 are provided under the sole body 2. The outsole 4 is disposed mainly at the forefoot region F of the sole body 2, and the outsole 5 is disposed mainly at the heel region H of the sole body 2. There is provided a cushion pad 40 on a bottom surface 4A of the outsole 4 at a region corresponding to a thenar eminence of the foot. The cushion pad 40 is a member that has a cushioning function of protecting the thenar eminence from impact and that has a function of restraining energy loss during activities. In this embodiment, the cushion pad 40 is formed of ethylene-vinyl acetate copolymer (EVA) and its hardness is set at 48 C (±4 C for a tolerance). Also, in the midfoot region M of the sole body 2, an air vent 20 is formed that penetrates vertically through the sole body 2.

Figure 5:
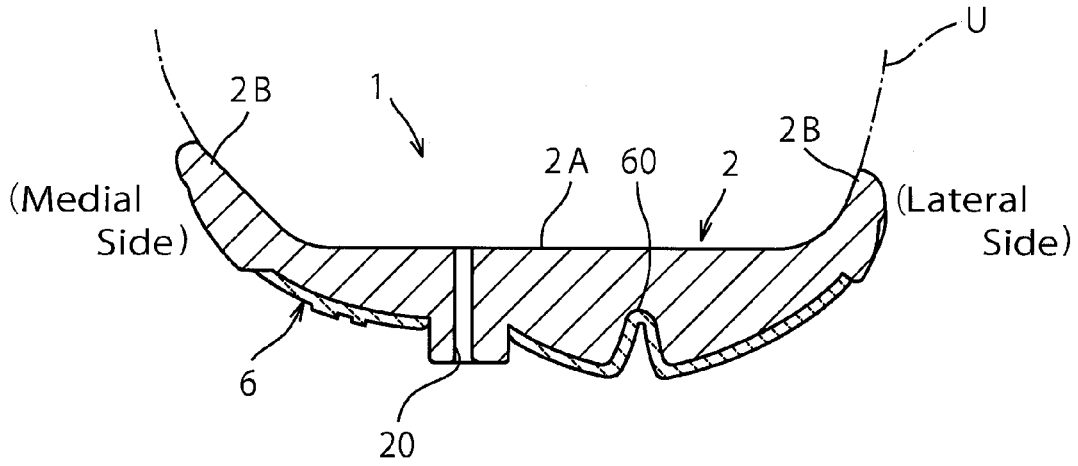
FIG. 5 is a cross sectional view of FIG. 4 taken along line V-V.

As shown in FIGS. 3 to 5, under the sole body 2, in a region extending from the heel region H to the midfoot region M of the sole body 2, a corrugated wavy sheet 6 is provided that has a wavy shape progressing in the longitudinal direction. The wavy corrugated sheet 6 is sandwiched between the sole body 2 and the outsole 5 in a region extending from the heel region H to a rear part of the midfoot region M of the sole body 2, and also sandwiched between the sole body 2 and the outsole 4 in a front part of the midfoot region M.

The wavy corrugated sheet 6 is preferably formed of a hard elastic material, more specifically, thermoplastic resin such as thermo plastic polyurethane (TPU), polyamide elastomer (PAE), acrylonitrile-butadiene-styrene (ABS) resin and the like, or thermosetting resin such as epoxy resin, unsaturated polyester resin and the like. In addition, the wavy corrugated sheet 6 may be formed of fiber reinforced prastics (FRP) formed of reinforcing fibers such as carbon fibers, aramid fibers, glass fibers or the like and matrix resin such as thermosetting resin or thermoplastic resin.

As shown in FIGS. 4 and 5, the wavy corrugated sheet 6 has a rib 60 that bends upwardly in an inverted V-shape (or an inverted U-shape) in the midfoot region M of the sole body 2. The rib 60 extends diagonally forwardly toward the lateral side of the midfoot region M as it goes forwardly from a laterally central position.

By forming the rib 60 in the wavy corrugated sheet 6, with regard to a rigidity of the midfoot region M of the sole body 2, the midfoot rigidity between the forefoot medial side and the heel lateral side of the sole body 2 is made lower than the midfoot rigidity between the forefoot lateral side and the heel medial side of the sole body 2, thus allowing for ease of pronation of the midfoot region M of the sole body 2. Moreover, with regard to the rigidity of the midfoot region M of the sole body 2, the midfoot rigidity between the forefoot medial side and the heel medial side of the sole body 2 is made lower than the midfoot rigidity between the forefoot lateral side and the heel lateral side of the sole body 2, thus further allowing for ease of pronation of the midfoot region M of the sole body 2.

There is provided a toe guard 7 on the foot sole contact surface or top surface 2A at a toe portion of the sole body 2. The toe guard 7 extends upwardly and arcuately along the toe. The toe guard 7 includes protruded portions 7A and 7B each having a bonding part that is bonded to the top of the sole contact surface or top surface 2A. The protruded portions 7A, 7B are disposed on the medial and lateral sides of the sole body 2, respectively.

Figure 6:
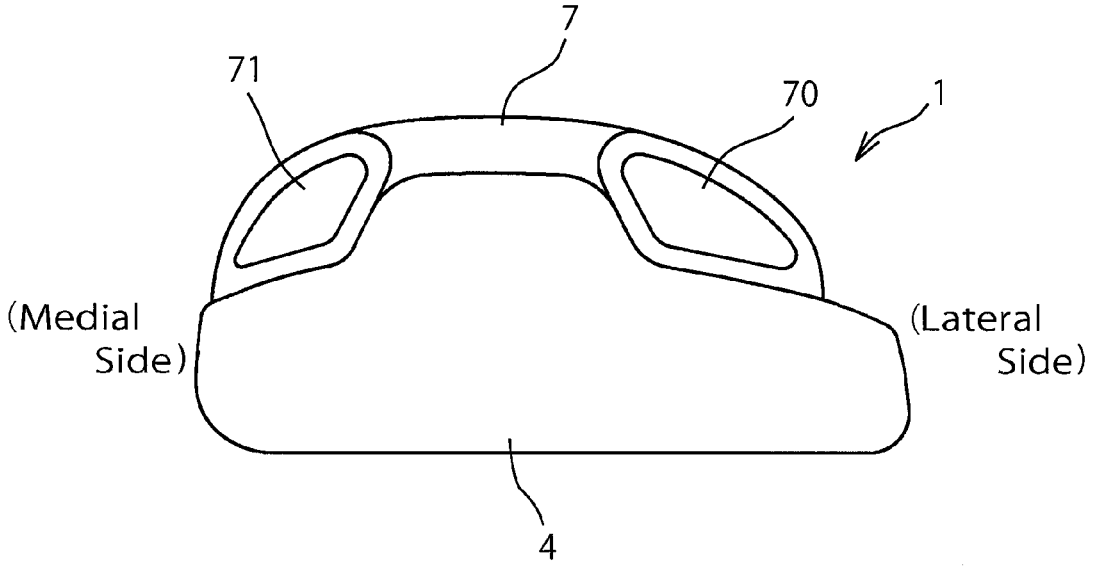
FIG. 6 is a front end view of FIG. 4 viewed from an arrow mark VI.

The toe guard 7 is formed of a hard material including thermoplastic resin such as thermoplastic polyurethane, nylon and the like. As shown in FIG. 6, on the medial and lateral sides of a front surface of the toe guard 7, slip-preventive portions 70, 71 are respectively provided. These slip-preventive portions 70, 71 are formed of a material of grip performance such as rubber, thermoplastic elastomer and the like.

Next, in order to verify effects of the present embodiment, volleyball shoes employing the sole structure according to the present embodiment were prepared. Professional volleyball players wore the shoes and actually spiked a ball with their shoes on. Then, a foot pressure distribution and load (thus, center of foot pressure) transfer path were measured. Prior to measurement, a sock liner (or insole) with sensors for foot pressure measurement attached was inserted into each of the shoes. For comparison, the players wore the conventional volleyball shoes as well, spiked a ball similarly with their shoes on, and then the foot pressure distribution and load (i.e. center of foot pressure) transfer path were also measured.

Figure 7:
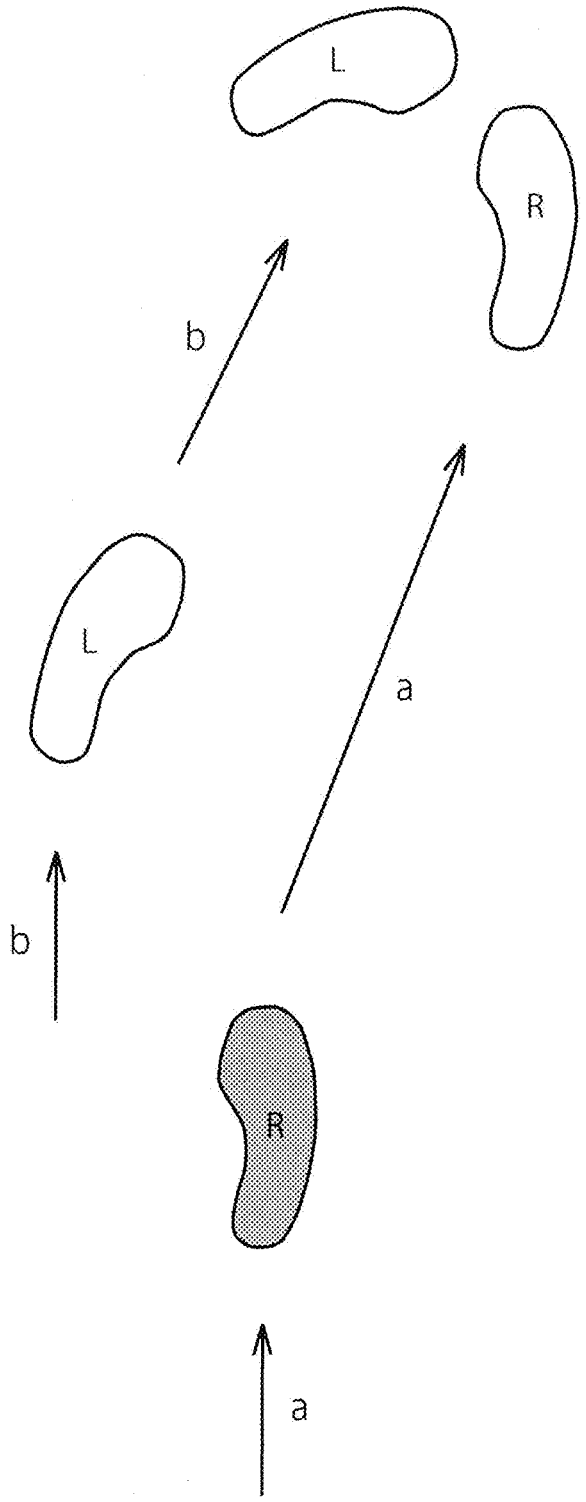
FIG. 7 is a schematic illustrating a motion of the foot when shifting to jumping at the time of a spike in volleyball.

FIG. 7 illustrates respective motions of a right foot (R) and a left foot (L) of a player when he or she spikes the ball. In the drawing, arrow marks a, b respectively designate the directions of the motions of the respective feet. With regard to the right foot colored with grey in FIG. 7, the foot pressure distribution and load (i.e. center of foot pressure) transfer path were measured. The measurement results are shown in FIGS. 8 and 9.

Figure 8:
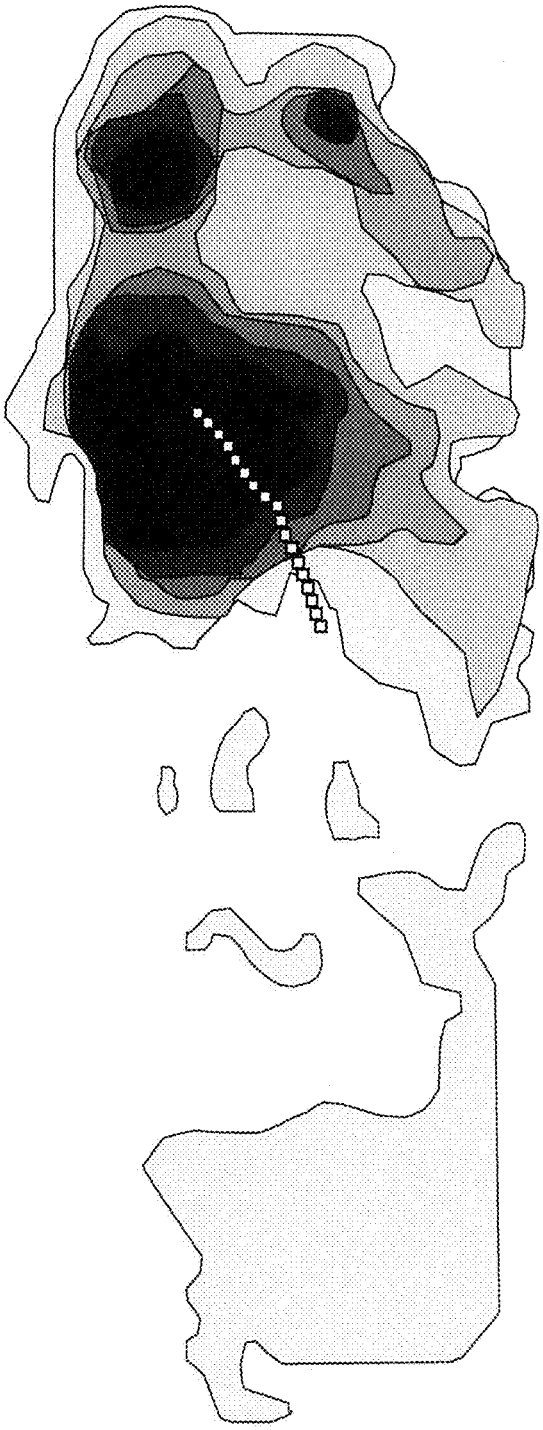
FIG. 8 is a foot pressure diagram when a player shifts to jumping wearing a shoe employing the sole structure of FIG. 1.
Figure 9:
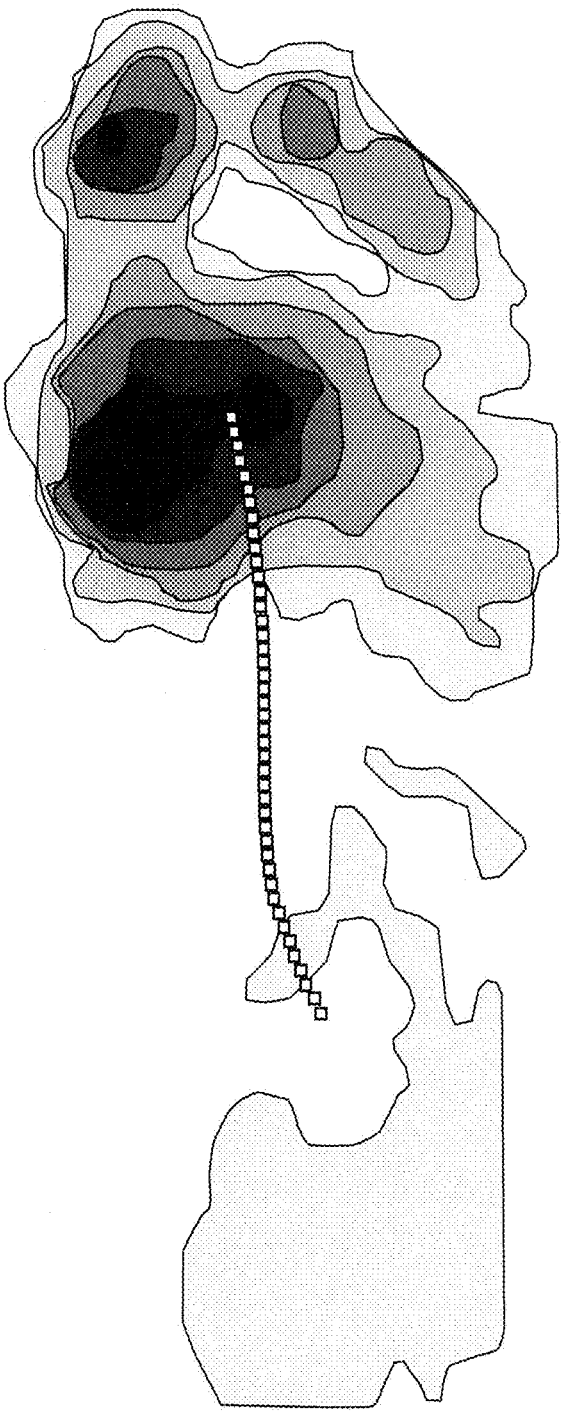
FIG. 9 is a foot pressure diagram when a player shifts to jumping wearing a prior-art shoe.

FIG. 8 illustrates the measurement results of the volleyball shoe employing the sole structure 1 according to the present embodiment and FIG. 9 illustrates the measurement results of the volleyball shoe of prior art. In each of the drawings, regions of deeper color designate higher foot pressure and each of small squares designates a center of foot pressure.

In either case of FIGS. 8 and 9, foot pressure at the forefoot region is high. However, as can be seen from comparison between FIG. 8 and FIG. 9, in the shoe of the present embodiment (see FIG. 8), portions of higher foot pressure are widely distributed at the entire region of the thenar eminence or the ball of the foot and distributed not only at the region right under the first toe (in particular, the first distal phalanx) but also at the region right under the second toe (in particular, the second distal phalanx). Also, in the shoe of the present embodiment, it is found that the load transfer path up to the forefoot region goes toward the inside or medial side (to the left direction in FIG. 8, i.e. on the side of the thenar eminence) of the forefoot region.

As mentioned above, in the sole structure 1 of the present embodiment, foot pressures at the time of activities are smoothly concentrated on the forefoot region and transfer of the foot pressures to the forefoot region is promptly conducted. It is considered that this is because formation of the rib 60 in the wavy corrugated sheet 6 allows for ease of pronation of the midfoot region M of the sole body 2. Also, the ground reaction force against the toes (especially, the first and second toes) is increased. It is considered that this is due to provision of the plate-like member 3 of high hardness on the foot contact surface 2A of the sole body 2. In this manner, as the ground reaction force increases, accelerating force during activities can be increased. Thereby, one can quickly move onto for example, a dash, sidestep, jumping and the like that require a push-off motion of the toes, and quick movements can thus be achieved.

Figure 10:
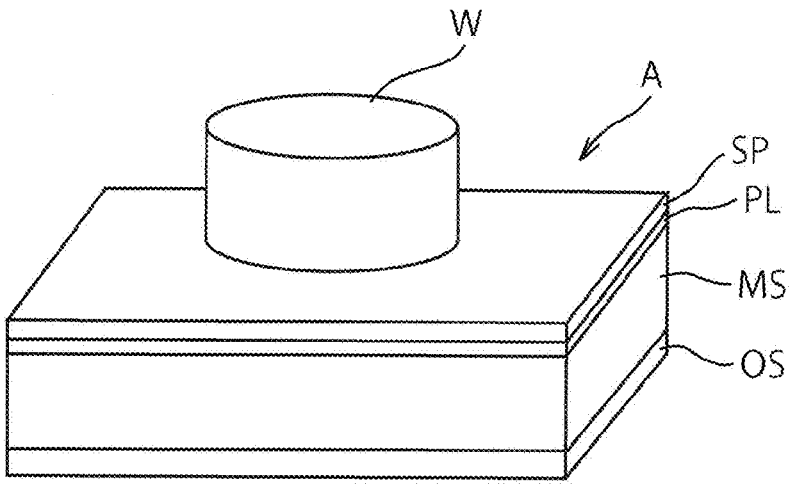
FIG. 10 is a model diagram to verify the effects of the present invention by computer simulation.

Then, we conducted an experiment by computer simulation in order to verify the effects of the sole structure 1 of the present embodiment, especially the plate-like member only. FIG. 10 is a model diagram of the computer simulation and FIG. 11 is a graph showing verification results of the computer simulation of FIG. 10.

As shown in FIG. 10, a structure A is composed of a sponge SP (that corresponds to an insole), plate PL (that corresponds to a plate-like member), a sole MS and an outsole OS, which are disposed in layers from top to bottom. A hardness of the plate PL (60 D in the Asker D scale) is set higher than a hardness of the sole MS (55 C in the Asker C scale). A weight W of 10 kg in weight is dropped from 60 mm above the structure A to hit the structure A. An upward vertical velocity of the weight W is calculated when the weight W rebounds after the impact on the structure A. The calculation result is shown in FIG. 11 (see 'Present invention'). In this drawing, the calculation result of the structure A without the plate PL (that corresponds to the prior art) is also shown (see 'Prior art (w/o plate)'). With regard to the prior art, similar experiment by computer simulation was also conducted.

Figure 11:
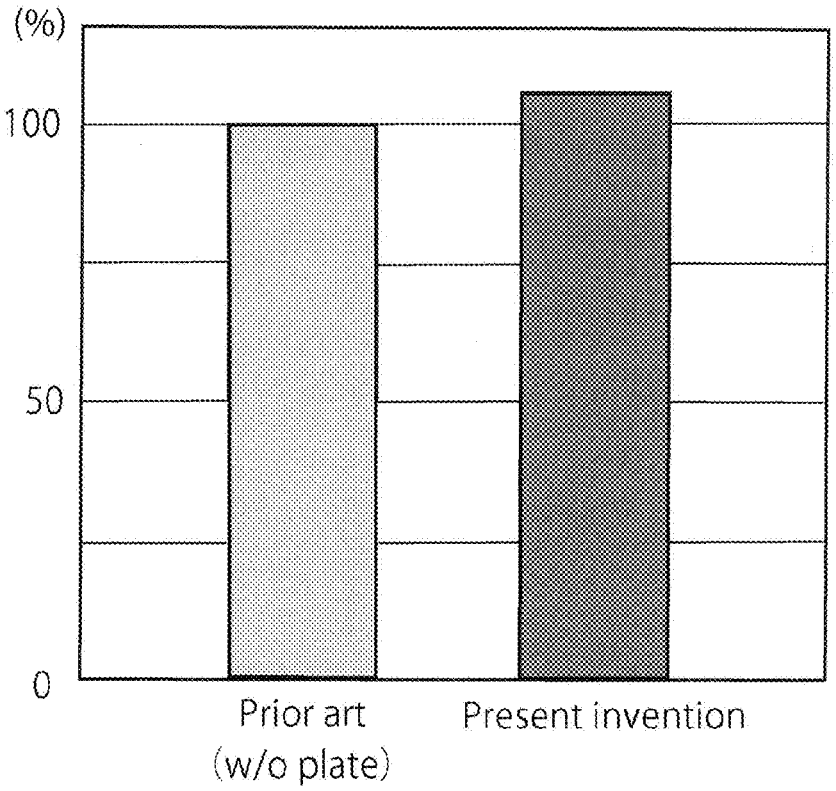
FIG. 11 is a graph showing verification results of the computer simulation of FIG. 10.

As can be seen from FIG. 11, when repulsion or rebound velocity of the weight W in the case of the prior art is set at 100, repulsion or rebound velocity of the weight W in the case of the present invention is 105 and thus increased by 5% compared with the prior art. Accordingly, it was verified that the repulsion or rebound force at the time of application of the load can be increased by provision of the plate-like member 3 on the sole body 2 in the sole structure 1 of the present embodiment.

Since the plate-like member 3 is located at the position corresponding to the toes of the foot on the foot sole contact surface 2A of the sole body 2, when the load is applied to the sole body 2 from the toes at the time of activities, a greater repulsion or rebound force can be obtained compared with the case in which the load from the toes is applied directly to the sole body 2 without the plate-like member 3. Thereby, accelerating force can be increased during activities, and as a result, one can quickly move onto for example, a dash, sidestep, jumping and the like that require a push-off motion of the toes. Quick movements can thus be attained. On the other hand, because the plate-like member 3 does not overlap with the metatarsophalangeal joints MP (see FIG. 2), cushioning properties at the time of impacting the ground is secured at the metatarsophalangeal joints MP and the peripheral areas thereof.

Moreover, according to the present embodiment, since the plate-like member 3 is located right under the first distal phalanx $DP_1$ to the fourth distal phalanx $DP_4$, the load at the time of push-off motion of the foot can be effectively transmitted to the plate-like member 3.

According to the present embodiment, as the plate-like member 3 has the narrow part 3C between the first plate-like portion 3A and the second plate-like portion 3B (that is, at the region between the first toe and the second to fourth toes), the region on the first toe side and the region on the second toe side, which are respectively disposed on opposite sides of the region between the first toe and the second toe, are easy to bend respectively in the foot width direction. Thereby, in either case of push-off motion on the first toe side or push-off motion on the fourth toe side, a smooth load (thus, COP: center of foot pressure) transfer can be attained. As a result, quick movements due to an increase of accelerating force at the time of activities can be achieved and at the same time a smooth COP transfer can be attained in either case of push-off motion on the first toe side or on the fourth toe side.

According to the present embodiment, as the toe guard 7 is provided, shifting of the foot at the time of push-off motion can be prevented by the toe guard 7.

Second Embodiment

Figure 12:
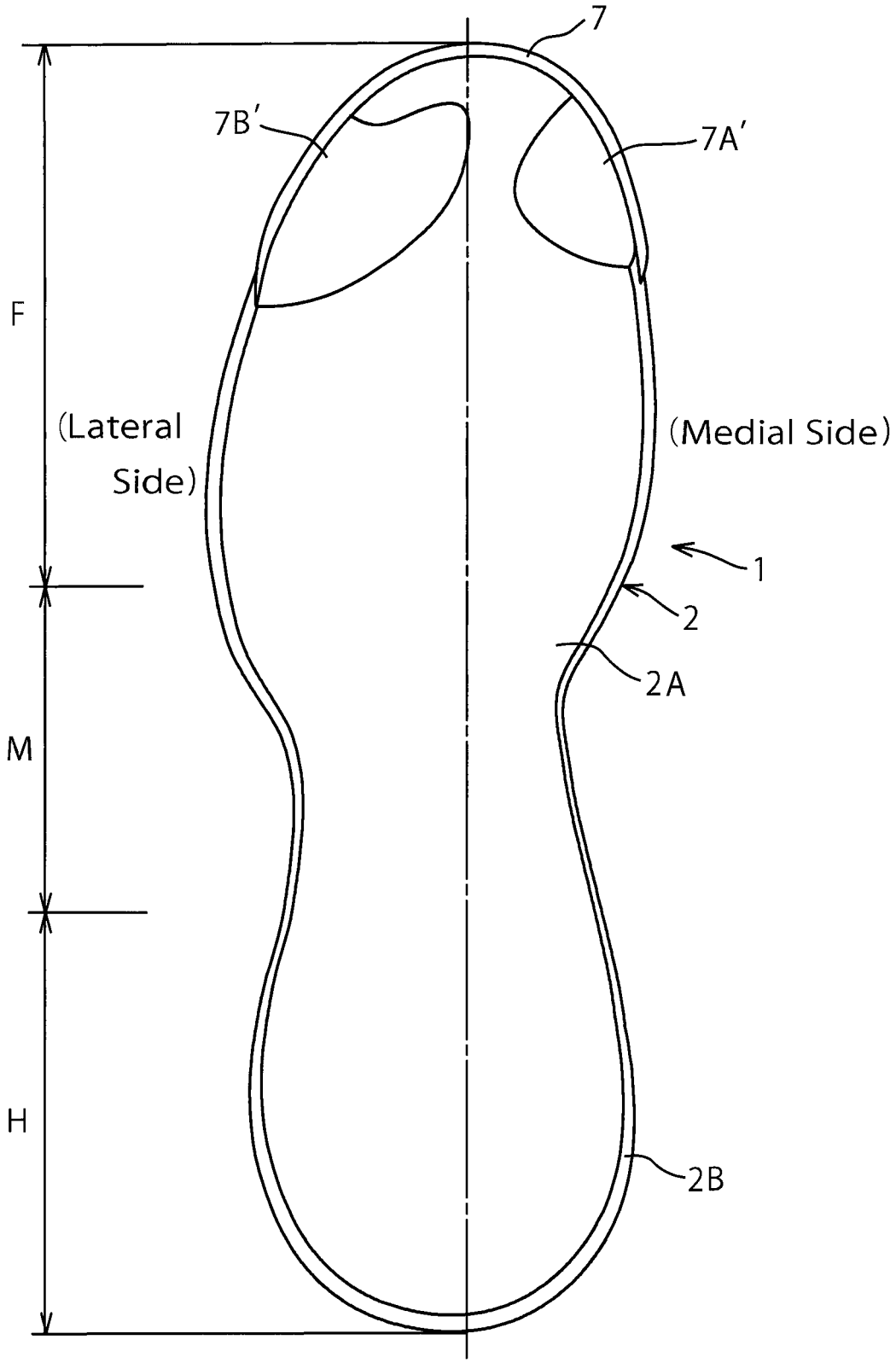
FIG. 12 is a top plan schematic view of a sole structure for a sport shoe according to a second embodiment of the present invention.
Figure 13:
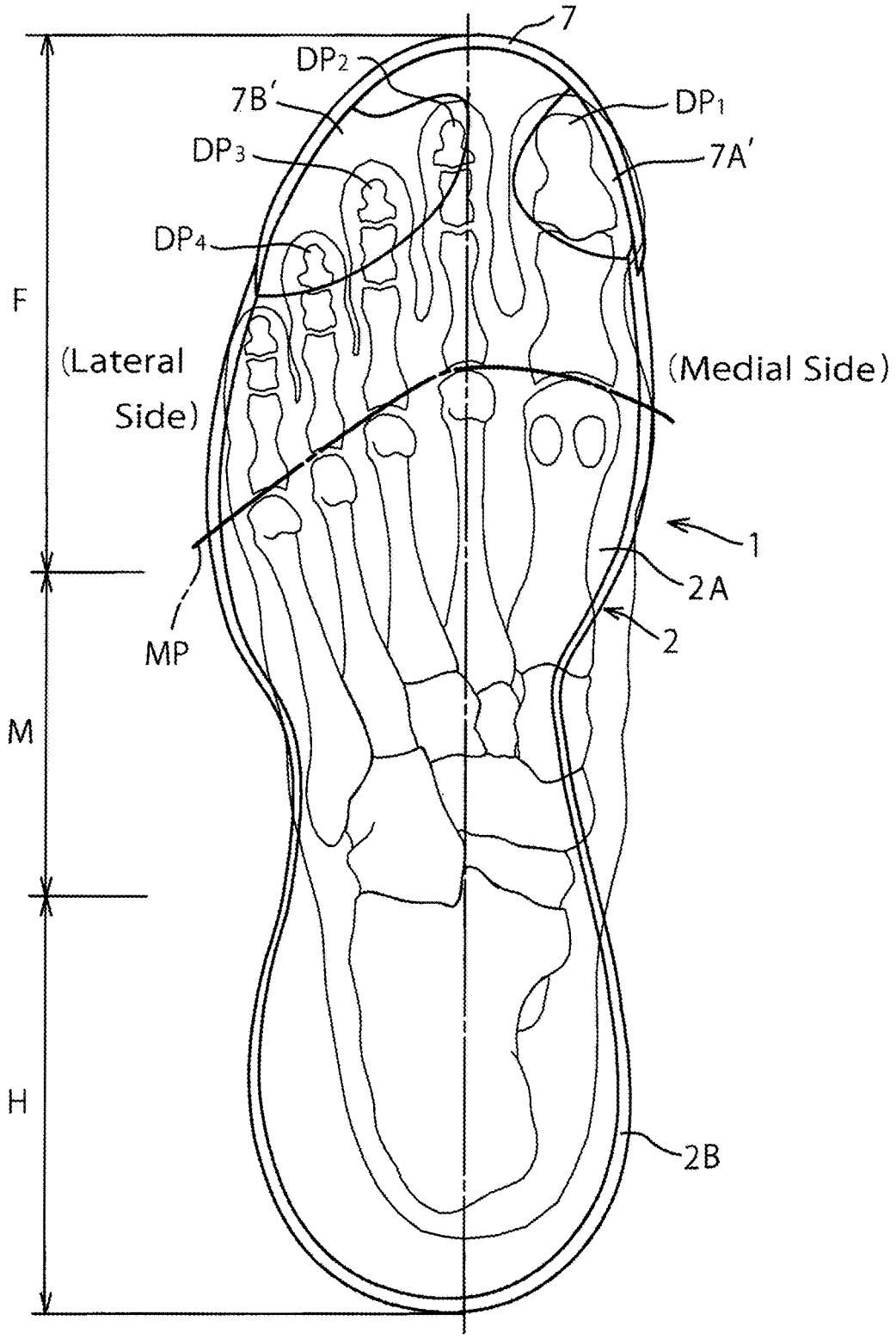
FIG. 13 is a top plan schematic view illustrating a positional relation between the sole structure of FIG. 12 and the bone structure of the foot.

FIGS. 12 and 13 show a sole structure for a sport shoe according to a second embodiment of the present invention. In these drawings, the same reference numbers as those of the first embodiment indicate identical or similar elements.

The second embodiment differs from the above-mentioned first embodiment in that respective protruding portions 7A', 7B' of the toe guard 7 protrude further inwardly than the respective protruding portions 7A, 7B of the toe guard 7 in the first embodiment and the plate-like member 3 in the first embodiment is not provided. In this case, the protruding portion 7A' corresponds to the first plate-like portion 3A in the first embodiment and the protruding portion 7B' corresponds to the second plate-like portion 3B in the first embodiment. Also, in this case, a member corresponding to the narrow part 3C in the first embodiment is not provided and there is formed a gap between the protruding portions 7A' and 7B'.

In other words, in this second embodiment, first and second plate-like portions 7A', 7B' extend up to the outer circumferential edge portion of the sole body 2 and have the upraised portion 7 extending upwardly around the outer circumferential edge portion. The upraised portion 7 functions as a toe guard.

According to the second embodiment, the region on the first toe side and the region on the second to fourth toe sides are easy to bend respectively in the foot width direction on opposite sides of the gap between the protruding portions 7A' and 7B'. Thereby, in either case of push-off motion on the first toe side or push-off motion on the fourth toe side, a smooth load (thus, COP: center of foot pressure) transfer can be attained. As a result, quick movements due to an increase of accelerating force at the time of activities can be achieved and at the same time a smooth COP transfer can be attained in either case of push-off motion on the first toe side or on the fourth toe side.

Also, according to the second embodiment, since the protruding portions 7A', 7B', which respectively correspond to the first and second plate-like members 3A, 3B in the first embodiment, are located at the position corresponding to the toes of the foot on the foot sole contact surface 2A of the sole body 2, as with the first embodiment, when the load is applied to the sole body 2 from the toes at the time of activities, a greater repulsion or rebound force can be obtained compared with the case in which the load from the toes is applied directly to the sole body 2. Thereby, accelerating force can be increased during activities, and as a result, one can quickly move onto, for example, a dash, sidestep, jumping and the like that require a push-off motion of the toes. Quick movements can thus be attained.

According to the second embodiment, since the protruding portions 7A', 7B' that function as the plate-like member 3 in the first embodiment are located right under the first distal phalanx $DP_1$ to the fourth distal phalanx $DP_4$, the load at the time of push-off motion of the foot can be effectively transmitted to the protruding portions 7A', 7B'.

According to the second embodiment, in the same manner as the first embodiment, as the toe guard 7 is provided, shifting of the foot at the time of push-off motion can be prevented by the toe guard 7.

As above-mentioned, preferred embodiments of the present invention have been discussed, but application of the present invention is not limited to these embodiments. The present invention includes various variants or alternative embodiments. Some of the alternative embodiments will be mentioned below.

First Alternative Embodiment

In the first embodiment, as the plate-like member 3, a deformed M-shaped member in a planar shape was taken for an example (see FIG. 1), but the planar shape of the plate-like member 3 is not limited to such a shape. The plate-like member 3 may include the first plate-like portion 3A that overlaps at least partially with the first toe (preferably, the first distal phalanx), the second plate-like portion 3B that overlaps at least partially with the second to fourth toes (preferably, the second to fourth distal phalanges), and the narrow part 3C disposed therebetween. Other any shapes can be adopted.

Second Alternative Embodiment

In the first embodiment, an example in which the plate-like member 3 has the narrow part 3C was shown, but the present invention also has application to the plate-like member 3 without the narrow part 3C. In this case, the plate-like member 3 may be formed of an arcuate or band-shaped member that overlaps at least partially with the first to fourth toes (preferably, the first to fourth distal phalanges) and that extends substantially in the foot width direction. Alternatively, the plate-like member 3 may be composed of the first plate-like member 3A and the second plate-like member 3B that is spaced away and separated from the first plate-like member 3A and that overlaps at least partially with the second to fourth toes (preferably, the second to fourth distal phalanges).

Third Alternative Embodiment

In the first embodiment, an example in which the sole body 2 has the toe guard 7 at the front end portion thereof was shown, but the toe guard 7 may be omitted.

Fourth Alternative Embodiment

In the first embodiment, an example was shown in which there is provided the wavy corrugated sheet 6 and formed the rib 60 at the midfoot region of the wavy corrugated sheet 6 and with regard to rigidity of the midfoot region M of the sole body 2 the midfoot rigidity between the forefoot medial side and the heel lateral side of the sole body 2 is made lower than the midfoot rigidity between the forefoot lateral side and the heel medial side of the sole body 2 and also the midfoot rigidity between the forefoot medial side and the heel medial side of the sole body 2 is made lower than the midfoot rigidity between the forefoot lateral side and the heel lateral side of the sole body 2. However, a flat sheet may be substituted for the wavy corrugated sheet 6 and a rib may be formed in the flat sheet. In the alternative, a shank member may be provided at a position corresponding to the rib 60 in the midfoot region M of the sole body 2 in the first embodiment.

Fifth Alternative Embodiment

In the second embodiment, an example was shown in which there is formed the gap between the protruding portion 7A' and 7B', but these protruding portions 7A', 7B' may be integral with each other without forming the gap. In this case, a narrow part may be formed between the protruding portion 7A' and 7B'. Alternatively, the protruding portions 7A', 7B' may be coupled with each other in an arcuate shape or a band-shape without the narrow part.

INDUSTRIAL APPLICABILITY

As mentioned above, the present invention is of use to a sole structure for a sport shoe, and it is especially suitable for a sport shoe preferred for indoor sports (in particular, ball-game sports) that requires accelerating force during activities and quick movements.

The invention claimed is:

1. A sole structure for a sport shoe adapted to be worn on a person's foot, wherein said sole structure comprises:

a sole body formed of a soft elastic member, having a top surface and a bottom surface opposite one another;

an outsole that is disposed on said bottom surface of said sole body and that is adapted to come into contact with a ground surface on which the sport shoe is supported; and first and second planar sheet members that are embedded in said top surface of said sole body;

wherein:

said planar sheet members have a hardness greater than a hardness of said soft elastic member of said sole body;

said planar sheet members are disposed forwardly away from a position corresponding to metatarsophalangeal joints of the person's foot;

said first planar sheet member is configured and disposed to overlap below a position corresponding to a first distal phalanx of the person's foot; and said second planar sheet member is configured and disposed to overlap below positions corresponding to second to fourth distal phalanges of the person's foot.

2. The sole structure according to claim 1, wherein said hardness of said planar sheet members is from 45D to 75D on the Asker D hardness scale.

3. The sole structure according to claim 1, wherein a top surface of said planar sheet members is exposed upwardly from said top surface of said sole body.

4. The sole structure according to claim 3, wherein said top surface of said planar sheet members is flush with said top surface of said sole body.

5. The sole structure according to claim 1, wherein said planar sheet members are configured and disposed so as not to extend below positions corresponding to second to fourth proximal phalanges of the person's foot.

6. The sole structure according to claim 1, wherein said planar sheet members are configured and disposed so as not to extend below a position corresponding to a fifth phalanx of the person's foot.

7. The sole structure according to claim 1, wherein said planar sheet members are configured and disposed only on a forward distal side of positions corresponding to respective longitudinal Centers of first to fourth proximal phalanges of the person's foot.

8. The sole structure according to claim 1, wherein said planar sheet members are spaced inwardly away from an outer peripheral edge of said sole body.

9. The sole structure according to claim 1, wherein said first and second planar sheet members are joined together as a unitary component by a connecting portion that forms a narrowed neck with a reduced dimension in a longitudinal direction of said sole structure in comparison to adjoining portions of said first and second planar sheet members.

10. The sole structure according to claim 1, wherein said planar sheet members respectively extend to an outer peripheral edge of said sole body.

11. The sole structure according to claim 10, further comprising an upraised portion that is connected to and extends upwardly from said planar sheet members at said outer peripheral edge.

12. The sole structure according to claim 11, wherein said upraised portion is a toe guard of said sole structure.

13. The sole structure according to claim 1, wherein said first and second planar sheet members are separated and spaced apart from one another in a transverse direction of said sole structure.

14. The sole structure according to claim 1, wherein said sole body includes a midfoot region, a forefoot medial side, a forefoot lateral side, a heel medial side and a heel lateral side, wherein said midfoot region has a first rigidity between said forefoot medial side and said heel lateral side, and a second rigidity between said forefoot lateral side and said heel medial side, and wherein said first rigidity is lower than said second rigidity.

15. The sole structure according to claim 1, wherein said sole structure and the sport shoe are configured and adapted for use in an indoor sport.

* * * * *